United States Patent [19]

Deslandes

[11] Patent Number: 4,901,548

[45] Date of Patent: Feb. 20, 1990

[54] KEY HEAD AND KEY FITTED WITH SUCH A HEAD

[76] Inventor: Gérard Deslandes, Rue Bayet 44, 6000 Charleroi, Belgium

[21] Appl. No.: 174,403

[22] Filed: Mar. 25, 1988

[30] Foreign Application Priority Data

May 14, 1987 [BE] Belgium ..... 8700533

[51] Int. Cl.[4] ..... E05B 19/04

[52] U.S. Cl. ..... 70/408; 70/456 R; 40/330

[58] Field of Search ..... 24/553; 40/330; 70/395, 70/408, 456 R, 460, 413, 414

[56] References Cited

U.S. PATENT DOCUMENTS

| | | | |
|---|---|---|---|
| 1,668,833 | 5/1928 | Thayer | 70/459 |
| 2,291,089 | 7/1942 | Okun | 70/458 |
| 2,759,279 | 8/1956 | Schlage | 40/330 |
| 2,759,280 | 8/1956 | Schlage | 40/330 |
| 3,349,589 | 10/1967 | Fricke | 70/395 |
| 3,729,965 | 5/1973 | Gartner | 70/408 X |
| 4,102,166 | 7/1978 | Hughes | 70/456 R |
| 4,276,582 | 6/1981 | Burnett | 70/456 R X |
| 4,305,267 | 12/1981 | Nish et al. | 70/395 |
| 4,349,975 | 9/1982 | Chubb | 40/330 |
| 4,354,368 | 10/1982 | Toyoda | 70/456 R |
| 4,562,712 | 1/1986 | Wolter | 70/456 R |

FOREIGN PATENT DOCUMENTS

| | | | |
|---|---|---|---|
| 904684 | 4/1986 | Belgium . | |
| 7043113 | 3/1971 | Fed. Rep. of Germany . | |
| 2739082 | 3/1978 | Fed. Rep. of Germany . | |
| 2712759 | 9/1978 | Fed. Rep. of Germany | 70/408 |
| 2411650 | 12/1978 | France . | |
| 2448607 | 2/1979 | France . | |
| 2577267 | 8/1986 | France | 70/408 |

*Primary Examiner*—Gary L. Smith
*Assistant Examiner*—Suzanne L. Dino
*Attorney, Agent, or Firm*—Beveridge, DeGrandi & Weilacher

[57] ABSTRACT

Key head that constitutes a piece of jewelry designed to be fitted, successively, with various keys and that comprises a case consisting of two parts to be assembled (9,32) at least, one of which (9) is fitted on the inner side with locking means (10–12, 14–16) that prevent any displacement of the cut section (6) of the key and of the bit (8) in relation to the aforesaid part of the case, in their plane, as well as, also on the inner side, with removable means of fixation (17 and/or 22,23) for the cut section in the locked position so as to prevent any rotary movement of this section and of the bit in relation to this part of the case, with these locking means and means of fixation not visible from the outside, subsequent to assembling.

8 Claims, 1 Drawing Sheet

KEY HEAD AND KEY FITTED WITH SUCH A HEAD

This invention relates to a key head that forms by itself a jewel or similar element designed to receive, successively, keys of various shapes, comprising a rigid case featuring two opposite walls that form intake surface areas, one peripheral wall arranged between the two intake walls and one inner cavity into which a section cut from the head of any conventional key, including automobile keys, can be lodged in a removable manner, with the peripheral wall of the case displaying an opening for letting through the bit of the conventional key, as well as means for locking the cut section of the key head inside the cavity of the case in a position adjacent to the aforesaid passage opening, with these means preventing, in relation to the key head, any displacement of the cut section and of the bit in their plane, with the case formed, at least, by two parts for assembly that are held together in a detachable manner by means of assembly. It also concerns a key that displays such a head.

A key head of this kind has already been described in the Belgian patent no. 904,684 granted to this applicant. This known key head is designed to serve as a jewel to be preserved and to which can be fitted various successive keys. This key head, however, has the drawback that the intake walls alone are provided for locking the cut section of the key in the cavity of the case so as to prevent any rotary movement of the cut section in relation to the aforesaid case. Consequently, as soon as the key used displays a thickness that is very slightly less as compared to the peripheral wall of the case, there is the possibility of an undesired relative displacement between the bit and the case. Furthermore, the only means of assembly described for the key head according to this patent are means of glueing. These means have the drawback that changing the key can not be carried out by a private person since a jeweller or the vendor of the key head who is alone to know the appropriate solvent and its method of use will necessarily have to intervene.

We also know a key head formed by a case that may form by itself an ornamental item designed to take a key (cfr. U.S. Pat. No. 3,349,589). The case of this known key head displays a downward opening that lets through not alone the bit but also the head of a key. The latter is kept in place inside the cavity of the case by an elastic element with two tightening arms, with the element able to engage with a recess of the head. The head of the key can therefore be sunk into or withdrawn from the case by opening the passage which allows, for instance, for lending the key without lending the ornamental case at the same time. In addition to the fact that this case is not adjustable to any conventional key, it has the drawback that the key is not fitted rigidly inside the case which has to give rise to problems in transmitting tractive, pushing and twisting efforts from the fingers to the key bit.

We also know keys, the metal head of which is fitted with a strengthening device in the form of a rigid case (cfr. French patent application no. 2448607). This case is designed, however, for whole keys only and does therefore not allow for using several successive keys of various shapes. Furthermore, the means for locking and fitting the key in the case are partly visible from outside which would be a considerable drawback for using this strengthening device as a jewel. In addition, they are not adjustable according to the thickness of the key used. A relatively similar device is described in U.S. Pat. No. 2,759,279.

We know, on the other hand, a case designed to frame key heads in such a manner as to enclose in the case not alone the key head, but also coins (cfr. U.S. Pat. No. 4,102,166).

We also know keys, the metal head of which is coated with plastic or other material which allows for distinguishing one key from the other. Frequently and prior to the coating, the key head will be cut. The cut section alone is coated with plastic material or inserted into a plastice material casing (cfr. French patent application no. 2411650 and Federal Republic of Germany patent application no. 2739062).

We know, finally, in particular for circular head keys, casings made of malleable plastic material into which the key heads can be fitted and by which they are partly covered. These envelopes serve only the purpose of differentiating one key from another and normally, a casing of this kind is not designed to be removed again from the key onto which it is fitted, although this is possible. Actually, such a casing will be removed when it is worn or torn and if it is to be replaced by another casing that is new or of a different colour. If the casing removed is undamaged, then it can possibly serve again, provided the key to be encased displays the same head shape as the previous one.

The object of this invention is to provide a key head designed to form a jewel or precious and ornamental item by itself, the fitting, locking and assembling means of which are not visible from outside or are visible only to a very limited extent. This key head must be able to serve for various keys of any nature, successively, according to the user's wish. It is the key head that is designed to be kept by the user and if he changes automobiles, for instance, it must be possible to use the key of his next automobile by means of the key head according to the invention in a manner that allows for perfect transmission of the tractive, pushing and twisting efforts applied to the key head according to the invention and from there to the key bit. The key head must not allow for any relative displacement between itself and the bit while the key is being maneuvered whichever the size of the key installed may be, in particular where thickness is concerned. Also, replacing one key by another in the key head according to the invention must be easily performed by the user himself. Only the cutting of the conventional key head will have to be performed by means of a special device that can be found at any keymaker's shop.

These problems are solved, according to the invention, by means of a key head as described above and characterized in that one of the parts of the case to be assembled displays on the inward-turned side of the case, the aforesaid locking means that prevent, when they are co-operating with the section cut in the latter's locking position, in relation to the aforesaid part of the case, any displacement of the section cut and of the bit in their plane, in that this part of the case to be assembled displays, furthermore, also on the inward-turned side of the case, removable means of fixation that are able to secure the section cut in a locked position and in such a manner as to prevent any rotary movement of the section cut in relation to this part of the case, and in that, subsequent to the assembly of the parts of the case to be assembled, the aforesaid locking means of the section cut are not visible from outside.

According to one form of embodiment of the invention, the aforesaid locking means comprise stops provided on the inner side of the part of the case that displays the locking means, with these stops arranged in relation one to the other in such a manner as to rest against the peripheral outline of the section cut of the key, either against the entire outline or against part thereof. The height of some of the stops, at least, will be maximum equal to the thickness of the thinnest conventional key heads in the event where these stops are arranged all around the section cut of the key.

According to one preferred form of embodiment of the invention, the aforesaid locking means consist of a recess provided on the inner face of the intake wall displayed by the aforesaid part of the case that features the locking means, with this recess displaying a previously determined shape, the peripheral outline of which will be smaller than any conventional key head, and the depth of which will be slightly less than or equal to the thickness of the thinnest conventional key heads.

According to one improved form of embodiment of the invention, the aforesaid means of fixation are adjustable according to the thickness of the section cut of the conventional key head used.

According to another improved form of embodiment of the invention, the aforesaid means of assembly of the parts of the case to be assembled are removable mechanical means of assembly, the part visible from the outside of which can be seen only on the peripheral wall of the case.

According to an improved form of embodiment of the invention, these means of assembly are designed so as not to be visible from the outside subsequent to the assembly.

Further details and special features of the invention will be shown by the description given below with no restrictive purpose in mind and with reference to the appended drawings.

Figure 1:
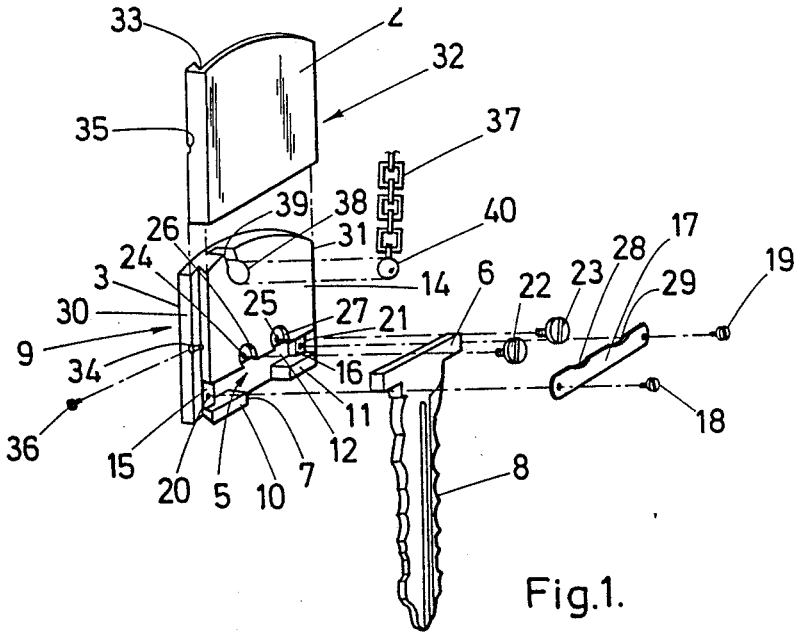
FIG. 1 shows an exploded perspective view of a form of embodiment of a key fitted with a key head according to the invention.
Figure 2:
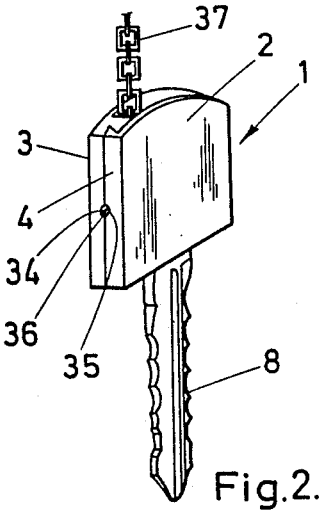
FIG. 2 shows a perspective view of the key according to FIG. 1 in the assembled state.
Figure 3:
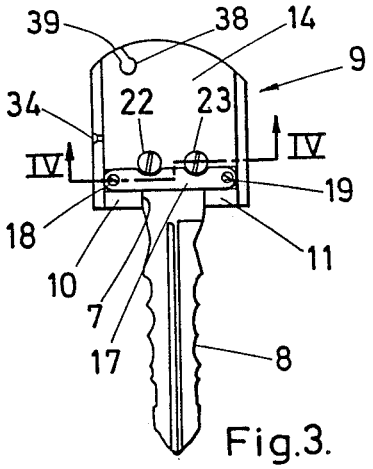
FIG. 3 shows a front view of the inside of the part of the case to be assembled, displaying the means for locking and securing the section cut and the bit of the conventional key installed.

In the drawings, the elements that are identical or similar are pointed out by the same references.

As shown by the example of embodiment illustrated in FIGS. 1 to 4, we use as a jewel or ornamental item a key head designed to be fitted successively with keys of various shapes. This key head comprises a rigid case 1 that displays two opposite walls 2,3 that form intake surfaces on the outer side. These intake surfaces are designed not alone to take the tractive, pushing or twisting efforts applied by the fingers in view of transmitting them to the key, but also possibly as ornamental surface areas. The case 1 comprises, furthermore, a peripheral wall 4 arranged between the two intake walls 2 and 3. These latter walls and the peripheral wall 4 constitute the casing of an inner cavity 5 of the case 1. Into this cavity, a cut section 6 of any conventional key, including automobile keys, can be lodged in a removable manner, as shown by FIG. 1. The peripheral wall 4 of case 1 displays an opening 7 located close to the cavity 5 and this opening is designed to leave passage to the bit 8 of the conventional key used outside the case 1.

As shown by FIG. 1 in the illustrated example of embodiment, the case 1 consists of two parts to be assembled. In the case illustrated, one of them, part 9 comprises the intake wall 3 and the parts 10,11 of the peripheral wall 4, located on both sides of the passage opening 7 for the bit 8. This part 9 to be assembled is fitted on the side directed toward the inside of the case with locking means for the cut section 6 of the conventional key head used. Here, these locking means consist of a recess 12 on the inner face of the intake wall 3. This recess displays an approximately rectangular shape with slightly rounded corners. It is limited in the longitudinal direction of the bit, on one side, by the parts 10 and 11 of the peripheral wall 4, which parts are located on both sides of the passage opening 7 for the bit, and on the opposite side by an internal thickening 14 of the intake wall 3 that is partly filling the cavity 5. Laterally to this direction, the recess 12 is limited by two ribs 15,16 that are projecting inwards in relation to the inner face of the intake wall 3. The recess 12 thus displays a previously determined shape, the peripheral outline of which will be smaller than any conventional key head. Consequently, the latter can always be cut according to the outline of the recess.

As a matter of fact, the parts 10 and 11 of the peripheral wall 4, on one hand, and the thickening 14, on the other, serve as stops that since they are resting against the peripheral outline of the cut section 6 of the key, prevent any displacement of the bit 8 and of the cut section 6 in relation to the part 9 of the case 1, in the longitudinal direction of the bit. The ribs 15,16 also serve as stops that since they are resting against the peripheral outline of the cut section 6 of the key, prevent any displacement of the bit 8 and of the cut section 6 of the key in relation to the part 9 of the case 1, laterally to the longitudinal direction of the bit. Consequently, once the cut section finds itself in the locking position inside the part 9 to be assembled of the case 1, the bit 8 and the cut section 6 become unable to effect any relative movement in relation to this part 9 of the case, in their plane.

In the example of embodiment as illustrated, we can see that the parts 10 and 11 of the peripheral wall 4 and the thickening 14 are projecting widely inwards and beyond the upper edge of the recess formed by the top of the lateral ribs 15 and 16. It has to be understood that the arrangement of the locking means may be different from that as described and illustrated. We could consider, in particular, instead of a recess of which all the edges are resting entirely on the cut section of the key, stops arranged one in relation to the other in such a manner as to rest in certain specified places against the peripheral outline of the cut section 6 of the key. In these forms of embodiment will be provided, preferably, that two opposite parts of stops or two opposite recess edges, at least, in the case illustrated, the lateral ribs 15,16 will display a maximum height equal to that of the thinnest conventional key heads.

One of the essential advantages of the invention resides in the fact that part 9 of the case that is fitted with the locking means described above, is also fitted on the side directed toward the inside of the case 1, with removable means of fixation that are capable of securing the section cut in a locked position in such a manner as to prevent any rotary movement of the cut section 6 in relation to this part 9 of the case. According to the example as illustrated, these means of fixation comprise a spring leaf 17 that covers partly or entirely the cut section 6 arranged in a locked position, as well as tightening screws 18,19 that pass through two holes made in the ends of the spring leaf 17 and that are tightened in tapped holes 20, 21 provided for at the top of the lateral ribs 15,16 as described above. As these ribs 15,16 have a maximum height equal to that of the cut section 6 and as the leaf 17 is resilient, the tightened spring leaf 17 will secure the cut section 6 in these means of fixation, whichever the thickness of the cut section 6 may be.

In the illustrated example of embodiment, the key head according to the invention comprises also additional means of fixation. These means include two fillister head screws 22,23. The latter are designed to be screwed into the tapped holes 24,25 made at the bottom of recesses 26, 27 provided for in the thickening 14. These recesses 26,27 are located in a position adjacent to the recess 12 and open laterally onto the latter in such a manner that when the screws 22,23 are being tightened, part of their head will project into the recess 12. The bottom of these recesses 26,27 is set at the height of the edge of the recess 12 or at a lower level. Facing the recesses 26,27 the spring leaf is cut in 28,29 in such a manner as to free the passage of the head of the screws 22,23 when they are being tightened. Whichever the thickness of the cut section 6 of the conventional key used may be, the screws 22,23, when tightened, will secure the section cut in these locking means.

It is obvious that we can slso consider using the spring leaf 17 alone or only the tightening screws 22,23. Other means of fixation adjustable according to the thickness of the head of the conventional key used may be considered without exceeding the framework of this invention.

It will thus be possible, with the key head according to the invention, to prevent any relative movement between the cut section 6 and the bit 8 of a key, on one hand, and the part 9 of the case, on the other, even before the assembling of the parts of the case to be assembled. This makes the assembly easier and allows for using means that, subsequent to such assembling, will be masked i.e. invisible from the outside. For a jewel, as a matter of fact, this aspect is highly important.

According to the form of embodiment as illustrated, the thickening 14 of the part 9 of the case 1 and the parts 10 and 11 of the peripheral wall 4 are formed along the lateral edges 30, 31 in such a manner as to form an arrowhead-shaped stud. The other part 32 to be assembled of the case 1 comprises the intake wall 2 and the upper lateral sections of the peripheral wall 4. The latter are shaped in such a manner as to form with the intake wall 2 a groove 33, the shape of which corresponds with that of the aforesaid arrowhead stud. We can also have the part 32 to be assembled slide on this stud until the two parts 9 and 32 to be assembled find themselves in a proper overlap position. In this position, we distinguish on the lateral edges 30,31 of the key head the boundary between the two parts 9 and 32 to be assembled (cfr/ FIG. 2). On one of these edges the line is broken by an opening formed by two semicircular recesses 34, 35 made in each of the parts 9 and 32 to be assembled. A screw 36 is put through this opening and tightened in a tapped hole not shown and provided laterally in the thickening 14.

In this example of embodiment, the means for stopping the sliding of the part 32 of the case on the part 9, i.e. the screw 36, is arranged on the peripheral wall of the case, consequently in a very discrete place that is not very awkward for the outer aspect of a jewel. This screw 36 could be replaced , for instance, by a self-locking pushbutton. We could provide, of course, a mechanical assembly for the parts of the case to be assembled, the means of which would appear on one or the other of the intake surface areas, but it would then become necessary for these means to be made part of the ornamention of the jewel.

A small chain 37 could be used for linking the key according to the invention to a key ring. In the example of embodiment as illustrated, a housing 38 is recessed into the thickening 14. This housing is opened to the outside via a thin opening 39 into which can be slipped the last link of the small chain. A chain end ball 40, known in itself, is received in the housing and it displays a diameter that is larger as compared to the opening 39 so as to secure the small chain to the key head according to the invention, in the assembled state of this key head.

The rigid case 1 designed as a jewel may be made, for instance, of a precious metal or alloy or of an ornamental rigid material, possible set with precious elements such as precious or semi-precious stones. The intake surface areas 2, 3 of the walls may be engraved or decorated in any manner desired. The key head according to the invention can thus be an item of quality that the user may wish to keep for all his life. The key head according to the invention has this advantage to offer as the bit of any conventional key can be adjusted to this head and easily removed to be replaced by another.

In addition to its quality as a piece of jewelry, the key head according to the invention can be adjusted to any conventional key, whichever the size of the head may be, in particular whichever the thickness of this head may be. The transmission of efforts from the fingers to the bit will not give rise to any problem when the key has to be changed and assembling and disassembling the key head are easily performed operations even for the owner of the jewel.

It has to be understood that this invention is not restricted in any manner to the form of embodiment described above and that many changes may be made therein without exceeding its framework.

It has also to be understood that the expression 'key head that constitutes by itself a jewel or similar element' must be understood to mean that it constitues not alone a precious piece of jewelry but also an ornamental item that is not precious by itself, such as a support for a small watch or for a picture. We can also conceive the case according to the invention as a support for an advertising message.

Figure 4:
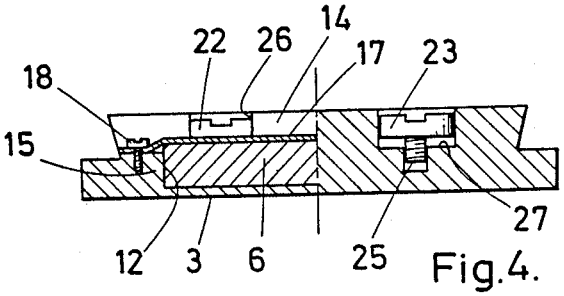
FIG. 4 shows a sectional view according to line IV—IV of FIG. 2, to an enlarged scale.
Figure 5:
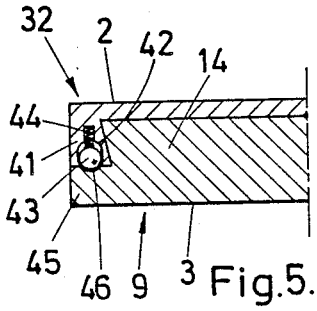
FIG. 5 shows a partial transverse sectional view of a variant of embodiment according to the invention.

As shown by FIG. 5, we may consider, instead of a screw fixation in 34 for assembling the parts 9 and 32 of the case (cfr. FIGS. 1 and 4), means that will co-operate in the assembled position in such a manner as to be no longer visible from the outside in the assembled position.

In the example of embodiment illustrated in figure 5, the upper lateral sections (of which only section 4 is shown) of the peripheral wall 4 are provided on their sliding surface area parallel to the intake surface area 2 with an open housing 42. Inside this housing 42 has been arranged a positioning ball 43 that is pushed outwards by a spring 44, in the direction of the opening of the housing 42 and in such a manner that it projects partly from the housing, prior to the assembling. As a matter of fact, the opening of the housing 42 is slightly smaller than the diameter of the ball 43 and it prevents the latter from being pushed out entirely under the action of the spring 44. During the sliding of the part 32 of the case on the part 9 of the case, the ball is pushed entirely inside the housing 42, against the action of the spring 44. The lower lateral sections (with only section 45 shown in FIG. 5) of the wall 4 are provided on their sliding face in parallel with the intake surface area 3, with a recess 46. This rcess displays a shape that is able to co-operate with the ball 43. When the latter is brought, through sliding, opposite the recess 46, it enters this recess under the action of the spring 44 and locks the sliding. The ball 43 and the recess 46 are designed mutually in such a manner that this locking occurs in the assembled position of the parts of the case 1.

I claim:

1. An ornamental key head designed to be fitted successively with keys having bits of various shapes and heads provided with cut sections formed by cutting the heads of conventional keys, comprising, a case formed of at least two parts that are held together in a removable manner, said case having an external surface that has two opposite walls and a peripheral wall, said case having an inner cavity for receiving a said cut section of a key, said peripheral wall of the case having an opening for receiving the bit of a key that has its cut section in said cavity, said opening being narrower than a portion of the cut section of the key, one said part of the case having an interior side, key locking means for locking the cut section of the key head inside the cavity of the case in a position near said opening to prevent the key from being displaced in its own plane relative to the head, said key locking means being mounted on said interior side of said one part of the case, fixation means for preventing the key from being moved rotationally and from being displaced perpendicularly to its own plane, said fixation means being adjustable according to the thickness of the cut section, said fixation means being mounted on said interior side of said one part of the case, and being operable, independently of the thickness of the cut section, to press the cut section of said bit against said interior side of said one part, said locking means and said fixation means being positioned where they are not visible when the case is assembled.

2. Key head according to claim 1 wherein the aforesaid locking means comprise stops provided on the inner side of the part of the case that is fitted with the locking means, with these stops arranged one in relation to the other in such a manner as to rest against the peripheral outline of the cut section of the key, over the entire length of this outline and in that, in the event where these stops are arranged all around the cut section of the key, the height of some of these stops, at least, will be maximum equal to the thickness of the thinnest conventional key heads.

3. Key heads according to claim 1, wherein the aforesaid locking means consist of a recess made on the inner face of the intake wall that is comprised by the aforesaid part of the case fitted with the locking means, with this recess displaying a previously determined shape with a peripheral outline that is smaller than any conventional key head and the depth of which is slightly less than or equal to the thickness of the thinnest conventional key heads.

4. Key head according to claim 1, wherein the aforesaid means of fixation include a spring leaf that over laps partly or entirely the aforesaid cut section in the locked position and that is secured, in particular by screwing, to the inner face of the part of the case to be assembled that is fitted with the locking means.

5. Key head according to claim 4, wherein the spring leaf is secured at its two ends in a place in relation to which the cut section is projecting, in particular on the aforesaid stops, the thickness of which is maximum equal to that of the thinnest conventional key heads or, respectively, on the edges of the aforesaid recess, the depth of which is less than or equal to the thickness of the thinnest conventional key heads.

6. Key head according to claim 1, wherein the aforesaid means of fixation comprise, at least, one screw that can be tightened in a tapped hole made in the inner face of the part of the case to be assembled that is fitted with the locking means and in that, in the locked position of the cut section and in the tightened position of the screw(s), with the head of the latter resting partly against the side of the cut section, opposite to the part of the case in which it is locked.

7. Key head according to claim 6, wherein the aforesaid means of fixation comprise, furthermore, a spring leaf that overlaps partly or entirely the aforesaid cut section in the locked position and that is secured, in particular by screwing, to the inner face of the part of the case to be assembled that is fitted with the locking means, with the spring leaf displaying one or more cutouts to allow one or more screws as described above to rest against the side of the cut section, opposite the part of the case in which it is locked.

8. Key, wherein it comprises a key head according to claim 1.

* * * * *